US007623123B2

(12) United States Patent
Kim

(10) Patent No.: US 7,623,123 B2
(45) Date of Patent: Nov. 24, 2009

(54) ORGANIC ELECTROLUMINESCENT DEVICE AND METHOD OF DRIVING THE SAME

(75) Inventor: Hak Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 695 days.

(21) Appl. No.: 11/318,515

(22) Filed: Dec. 28, 2005

(65) Prior Publication Data

US 2006/0146827 A1 Jul. 6, 2006

(30) Foreign Application Priority Data

Dec. 31, 2004 (KR) ..... 10-2004-0118583

(51) Int. Cl.
*G09G 3/30* (2006.01)

(52) U.S. Cl. ..... 345/204; 345/89; 345/98; 345/100; 345/205; 345/206; 345/211; 345/212

(58) Field of Classification Search ..... 345/88, 345/98, 100, 204, 205, 206, 211, 212
See application file for complete search history.

(56) References Cited

U.S. PATENT DOCUMENTS 5,020,124 A * 5/1991 D'Aoust et al. ..... 382/286
6,100,879 A * 8/2000 Da Costa ..... 345/211
6,580,653 B2 * 6/2003 Yamanaka ..... 365/210.1
6,909,472 B2 * 6/2005 Gadeyne et al. ..... 348/750
2002/0105508 A1 * 8/2002 Inada ..... 345/204
2003/0142046 A1 * 7/2003 Kasai et al. ..... 345/76
2003/0209721 A1 * 11/2003 Inoue ..... 257/98
2004/0161069 A1 * 8/2004 Eom ..... 375/369
2004/0242117 A1 * 12/2004 Park et al. ..... 445/25
2005/0099367 A1 * 5/2005 Kang et al. ..... 345/74.1
2005/0100101 A1 * 5/2005 Tsuzuki et al. ..... 375/240.28

OTHER PUBLICATIONS

IjnventorP Mun S H; Title: Flat panel display and driving method thereof: Jul. 13, 2002; Pub No. KR2002059490A Application Date: Jan. 6, 2001: Appl. No. 2001KR-000872.*

* cited by examiner

*Primary Examiner*—Bipin Shalwala
*Assistant Examiner*—Vince E Kovalick
(74) *Attorney, Agent, or Firm*—KED & Associates, LLP

(57) ABSTRACT

The present invention relates to an organic electroluminescent device that can reduce power consumption and is appropriate for low gray scale images. The organic electroluminescent device includes a controller and a data driver. The controller compares first digital video data inputted from the outside with a reference value, and adds first dummy bit data or second dummy bit data to the first digital video data in accordance with result of the comparison, thereby generating second digital video data. The data driver generates current corresponding to the first digital video data by using a method corresponding to the dummy bit data included in the generated second digital video data. The organic electroluminescent device uses a PAM method or a PWM method to drive the display based on the gray scale level of the digital video data. For low level gray scale images, the PWM method is used, which ensures a good quality image. For higher level gray scale images, the PAM method is used, which reduces power consumption.

27 Claims, 4 Drawing Sheets

ORGANIC ELECTROLUMINESCENT DEVICE AND METHOD OF DRIVING THE SAME

CROSS REFERENCE TO RELATED APPLICATION

This application claims priority from Korean Patent Application No. 2004-118583, filed on Dec. 31, 2004, the contents of which are incorporated herein by reference in its entirety.

BACKGROUND OF THE INVENTION

1. Field of the Invention

The present invention relates to a display device, and more particularly to an organic electroluminescent device and a method of driving the same.

2. Background of the Related Art

Recently, many light-emitting devices having small weight and volume have been developed. These new displays include liquid crystal displays (LCDs), field emission displays (FEDs), plasma display panels (PDPs), organic electroluminescent devices, and others. The organic electroluminescent devices are advantageous because they are thin, lightweight and flexible. However, it is necessary to overcome some disadvantages in known organic electroluminescent display devices.

SUMMARY OF THE INVENTION

It is a feature of the present invention to provide an organic electroluminescent device that can reduce power consumption and is appropriate for low gray scale, and a method of driving the same.

An organic electroluminescent device according to one embodiment of the present invention includes a controller and a data driver. The controller compares first video data inputted from the outside with a reference value, and adds first dummy bit data or second dummy bit data to the first video data in accordance with result of the comparison, thereby generating second video data. The data driver generates current corresponding to the first video data by using a method corresponding to the dummy bit data included in the generated second video data.

In other embodiments of the invention, the controller might only add dummy bit data if the PWM method is to be used, and the data driver would use the PAM method if no dummy bit data has been added. Conversely, dummy bit data might be added to indicate that the PAM method should be used, and the PWM method would be used in the absence of dummy bit data. In still other embodiments of the invention, the controller might communicate directly with the data driver to indicate the type of driving method that should be used.

A method of driving an organic electroluminescent device according to one embodiment of the present invention comprises comparing first input video data with a reference value to generate second video data including first dummy bit data or second dummy bit data; and generating current corresponding the first video data by using a method corresponding to the dummy bit data included in the generated second video data.

If the first video data has values lower than the reference value, indicating low gray scale images, the dummy bit data will indicate that the PWM should be used to ensure that the low gray scale images are clear. However, when the first video data has values greater than the reference value, the dummy bit data will indicate that the PAM method should be used, to conserve power.

As described above, an organic electroluminescent device and a method of driving the same use PAM method or PWM method in accordance with gray scale corresponding to digital video data. Thus, its power consumption is reduced, and an image having low gray scale is naturally displayed on the organic electroluminescent device.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements, and wherein.

DETAILED DESCRIPTION OF PREFERRED EMBODIMENTS

Hereinafter, the preferred embodiments of the present invention will be explained in more detail with reference to the accompanying drawings.

Figure 1:
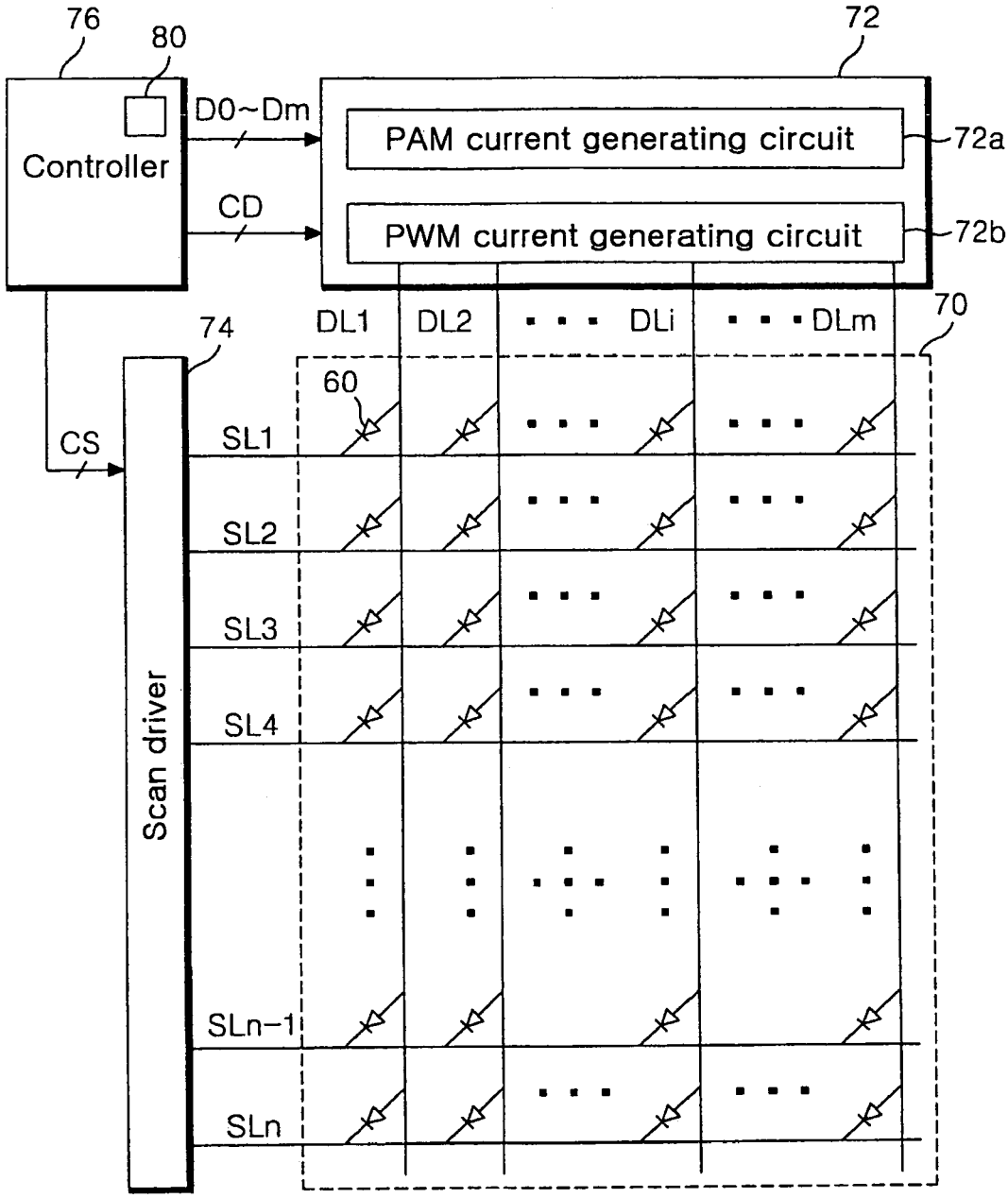
FIG. 1 is a block diagram illustrating an organic electroluminescent device according to one embodiment of the present invention.

FIG. 1 is a block diagram illustrating an organic electroluminescent device according to one embodiment of the present invention. An electroluminescent device embodying the present invention may be used in or formed as a flexible display for electronic books, newspapers, magazines, etc. The electroluminescent displays embodying the invention can also be used in various types of portable devices, e.g., handsets, MP3 players, notebook computers, etc., audio applications, navigation applications, televisions, monitors, or other types of devices that require a display, either monochrome or color.

An organic electroluminescent device embodying the present invention includes a panel 70, a data driver 72, a scan driver 74 and a controller 76. The panel 70 includes a plurality of pixels 60 formed in cross areas of data lines (DL1 to DLm) and scan lines (SL1 to SLn).

A controller 76 includes a register 80 or another device which stores a predetermined reference value. The controller 76 transmits a controlling signal (CS) to the scan driver 74. In addition, the controller 76 compares the reference value with first digital video data of n bit inputted from the outside, and generates second digital video data in accordance with the comparison. Then, the controller 76 provides a data controlling signal (CD) and the generated second digital video data to the data driver 72.

Figure 2:
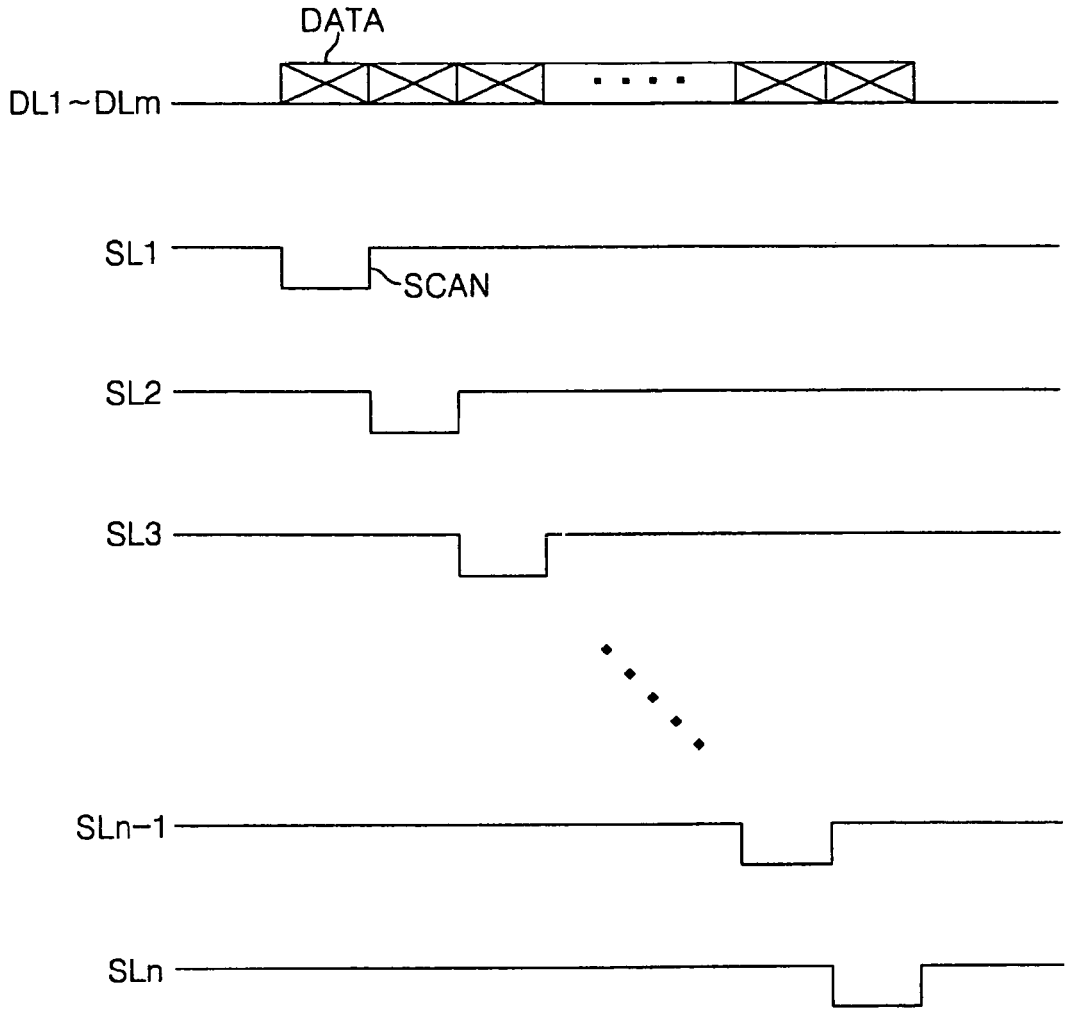
FIG. 2 is a timing diagram illustrating a process of driving the organic electroluminescent device of FIG. 1.

The scan driver 74 transmits, in sequence, scan signals to the scan lines (SL1 to SLn). FIG. 2 shows a timing diagram that illustrates how the scan signals are applied to the scan lines by the scan driver 74, and how data signals are applied to the data lines by the data driver. The data driver can use multiple different modulation methods to apply data signals to the data lines, including a pulse amplitude modulation (PAM) method or a pulse width modulation (PWM) method.

Figure 3:
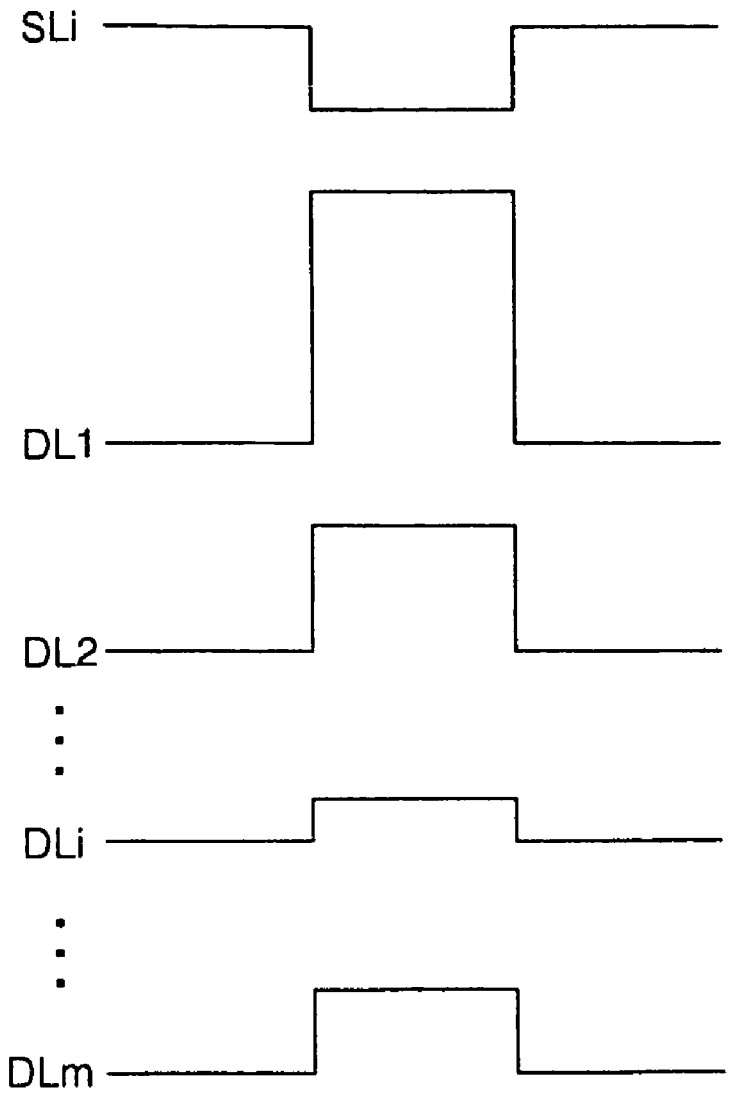
FIG. 3 is a timing diagram illustrating a method of driving the organic electroluminescent device by using the PAM method.

FIG. 3 is a timing diagram illustrating a method of driving the organic electroluminescent device by using the PAM method. In FIG. 3, the data driver 72 applies data signals, i.e. data current corresponding to the digital video data, to the data lines (DL1 to DLm) by using the PAM method. In this case, the gray scale of the pixels is proportionate to the amplitude of the data current, as shown in FIG. 3. In the data current, the time to have high logic is constant irrespective of the gray scale corresponding to the digital video data.

Figure 4:
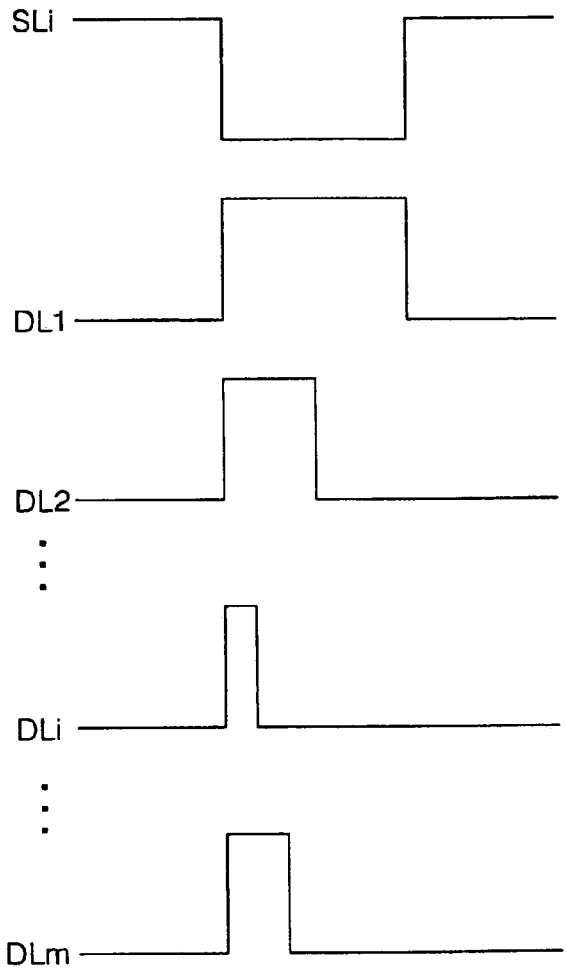
FIG. 4 is a timing diagram illustrating a method of driving the organic electroluminescent device by using the PWM method.

FIG. 4 is a timing diagram illustrating a method of driving the organic electroluminescent device by using the PWM method. In FIG. 4, the data driver 72 applies data signals, i.e. data current corresponding to the digital video data, to the data lines (DL1 to DLm) by using the PWM method. In this case, the gray scale of the pixels is proportionate to the time of high logic in the data current as shown in FIG. 4. Here, the amplitude of the data current is constant irrespective of the gray scale corresponding to the digital video data.

The power consumption in an organic electroluminescent device using the PAM method is smaller than that in an organic electroluminescent device using the PWM method. However, an image corresponding to low gray scale is not displayed naturally on the organic electroluminescent device using the PAM method. Alternatively, an organic electroluminescent device using the PWM displays low gray scale images quite well, but the power consumption is higher than when the PAM method is used.

In the embodiment shown in FIG. 1, the data driver 72 includes a PAM current generating circuit 72A and a PWM current generating circuit 72B. The data driver 72 will use either the PAM current generating circuit 72A or the PWM current generating circuit 72B to drive the panel 70, depending on the gray scale level of the image signal as detected by the controller 76. When image signals having a relatively high gray scale level are to be displayed, the PAM method is used to minimize power consumption. When image signals having a relatively low gray scale level are to be displayed, the PWM method is used to ensure that good image quality is maintained.

As mentioned above, the PAM current generating circuit 72A generates data current having amplitude proportionate to gray scale corresponding to the second digital video data. Alternatively, the PWM current generating circuit 72B generates constant current during a period of time proportionate to gray scale corresponding to the second digital video data.

Figure 5:
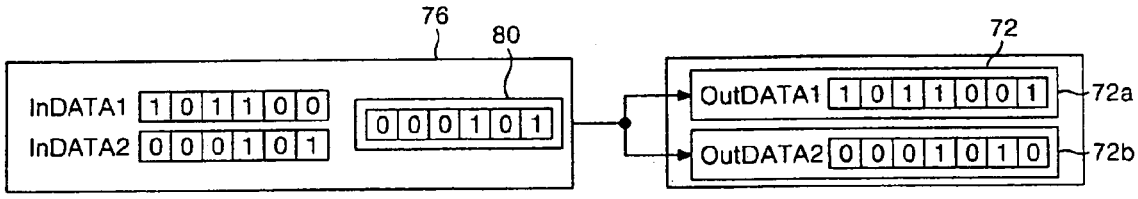
FIG. 5 is a block diagram illustrating the first digital video data and the reference value.

Hereinafter, a process of driving the organic electroluminescent device of the present invention will be described in detail with reference to FIG. 5. FIG. 5 is a block diagram illustrating the first digital video data and a reference value. In this example, the first digital video data has 6 bits (D0 to D5).

In FIG. 5, a first input digital video data (InDATA1), D0 to D5 has values of 1, 0, 1, 1, 0 and 0, respectively. A second input digital video data (InDATA2), which is inputted just after the first digital video data, has values of 0, 0, 0, 1, 0 and 1, respectively. Further, the reference value 80, D0 to D5 has values of 0, 0, 0, 1, 0 and 1, respectively.

The controller 76 compares the InDATA1 with the reference value. In this case, the value of the InDATA1 is higher than the reference value, and thus first dummy bit data having logic value "1" is added to the InDATA1. As a result, first output digital video data having values of 1, 0, 1, 1, 0, 0 and 1 (Do to D6) are generated.

In addition, the controller 76 compares the value of the InDATA2 with the reference value. In this case, the value of the InDATA2 is not higher than the reference value, and thus second dummy bit data having logic value "0" is added to the InDATA2. As a result, second output digital video data having the values of 0, 0, 0, 1, 0, 1 and 0 (D0 to D6) are generated.

The data driver 72 checks the value of the dummy bit data to determine which method to use to drive the panel 70. The data driver 72 uses the PAM current generating circuit 72A to drive the panel 70 by the PAM method when the dummy bit has a logic value of 1. Alternatively, the PWM current generating circuit 72B is used to drive the panel 70 when the dummy bit has a logic value of 0.

In the data driver 72 according to one preferred embodiment of the present invention, the PAM current generating circuit 72A is used about 50 to 80% of the time, and the PWM current generating circuit 72B is used about 20 to 50% of the time. The PAM current generating circuit 72A and the PWM current generating circuit 72B may be used at other relative percentages by adjusting the value of the reference value.

As described above, in case the value of the first digital video data is higher than the reference value, the first dummy bit data having logic value "1" is added to the first digital video data. Otherwise, the second dummy bit data having logic value "0" is added to the first digital video data. However, dummy bit data may be added to the first digital video data by using another method. Hence, it will be apparent to those skilled in the art that many modifications for the basic method are possible.

In alternate preferred embodiments of the invention, dummy bit data might only be added if an alternate, non-standard modulation method is to be used. In this embodiment if no dummy bit data is added to the input video data, a default modulation method would be used to drive the display. If dummy bit data is added, then an alternate modulation method would be used. For instance, dummy bit data might only be added when the gray scale level of the input video data is below a reference value. When the dummy bit data is present, the system would use the PWM method. If no dummy bit data is present, the system would use the PAM method.

In still other preferred embodiments, the controller might directly communicate with the data driver to indicate which driving method is to be used.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A circuit for driving an electroluminescent device, comprising:

a controller configured to determine whether a gray scale of input video data is greater than a reference value and configured to add first dummy bit data or second dummy bit data to the first video data, depending on the gray scale of the input video data, to thereby generate second video data; and a data driver configured to generate data signals corresponding to the first video data using a method corresponding to the dummy bit data included in the generated second video data.

2. The circuit of claim 1, wherein the first dummy bit data have a different logic value from the second dummy bit data.

3. The circuit of claim 1, wherein the data driver comprises:

a first signal generating circuit configured to generate data signals having an amplitude corresponding to the first video data when the dummy bit data included in the generated second video data are the first dummy bit data; and a second signal generating circuit configured to generate substantially constant amplitude signals during a period of time that corresponds to the first video data when the dummy bit data included in the generated second video data are the second dummy bit data.

4. The circuit of claim 1, wherein the first dummy bit data are added to the first video data when a gray scale value of the first video data is greater than the reference value.

5. The circuit of claim 1, wherein the second dummy bit data are added to the first video data when a gray scale value of the first video data is less than the reference value.

6. The circuit of claim 1, wherein the controller includes a register for storing the reference value.

7. An organic electroluminescent display device incorporating the circuit of claim 1.

8. The circuit of claim 1, wherein the first dummy data bit or the second dummy data bit is provided at an end of the first video signal to generate the second video data.

9. The circuit of claim 1, wherein the first dummy bit data comprises a logical '1' bit or a logical '0' bit.

10. A circuit for driving an electroluminescent device, comprising:

a controller that receives a first video signal and that outputs a second video signal based on a gray scale of the first video signal, wherein the first video signal is different from the second video signal, and wherein the controller is configured to add dummy bit data to the first video signal to thereby generate the second video signal, and wherein the dummy bit data is indicative of a gray scale level of the first video signal; and a data driver that outputs data signals based on the second video signal.

11. The circuit of claim 10, wherein the data driver is configured to output data signals according to a first driving method when the gray scale of the first video signal is greater than a reference value, and wherein the data driver is configured to output data signals according to a second driving method when the gray scale of the first video signal is less than the reference value.

12. The circuit of claim 11, wherein the first driving method is a pulse amplitude modulation method.

13. The circuit of claim 12, wherein the second driving method is a pulse width modulation method.

14. The circuit of claim 11, wherein the second driving method is a pulse width modulation method.

15. The circuit of claim 10, wherein the data driver outputs data signals according to a first method when the dummy bit data in the second video signal indicates that the gray scale level of the first video signal is greater than a reference value, and wherein the data driver outputs data signals according to a second method when the dummy bit data in the second video signal indicates that the gray scale level of the first video signal is less than the reference value.

16. The circuit of claim 15, wherein the first method is a pulse amplitude modulation method, and wherein the second method is a pulse width modulation method.

17. An organic electroluminescent display device comprising the circuit of claim 10.

18. The circuit of claim 10, wherein the dummy bit data comprises a logical '1' bit or a logical '0' bit.

19. An electroluminescent device, comprising:

a plurality of data lines in a first direction;

a plurality of scan lines in a second direction, the first direction being different from the second direction;

a plurality of sub-pixels, each sub-pixel including a corresponding data line and a corresponding scan line;

a scan driver coupled to the plurality of scan lines;

a controller configured to receive input video data and to determine whether a gray scale level of the input video data is greater than a reference value or less than the reference value; and a data driver coupled to the plurality of data lines, the data driver comprising:

a first signal generating circuit configured to drive the device using a first driving method, and a second signal generating circuit configured to drive the device using a second driving method, wherein the first driving method is different from the second driving method, wherein the data driver is configured to receive signals from the controller that indicate a gray scale level of the input video data, and wherein the data driver is configured to cause either the first signal generating circuit or the second signal generating circuit to drive the electroluminescent device depending on the gray scale level of the input video data.

20. The electroluminescent device of claim 19, wherein the first signal generating circuit is configured to drive the device using a pulse amplitude modulation (PAM) method.

21. The electroluminescent device of claim 19, wherein the second signal generating circuit is configured to drive the device using a pulse width modulation (PWM) method.

22. The electroluminescent device of claim 19, wherein the controller is configured to add data to the input video data to generate one of first video data and second video data based on the input video data, at least one of the first video data or the second video data being different from the input video data, and wherein the added data is indicative of the gray scale level of the input video data.

23. The electroluminescent device of claim 22, wherein the first video data is different from the second video data.

24. The electroluminescent device of claim 22, wherein the data driver is configured to read the data added to the input video data, and wherein the data driver is configured to cause either the first signal generating circuit or the second signal generating circuit to drive the device, depending on the gray scale level of the input video data as reflected in the added data.

25. The electroluminescent device of claim 19, wherein each of the plurality of sub-pixels includes an organic electroluminescent layer for light emission.

26. The electroluminescent device of claim 19, wherein the first driving method is used when the gray scale of the input video data is greater than a reference value, and wherein the second driving method is used when the gray scale of the input video data is less than the reference value.

27. A method of driving an electroluminescent device, comprising:

detecting a gray scale level of input video data;

generating second video data based on the input video data;

driving the electroluminescent device using a first driving method when the gray scale level of the input video data is greater than a reference value; and driving the electroluminescent device using a second driving method when the gray scale level of the input video data is less than the reference value, wherein driving the electroluminescent device using the first driving method includes generating data signals having an amplitude corresponding to the input video data when a dummy bit data included in the generated second video data are first dummy bit data, and wherein driving the electroluminescent device using the second driving method includes generating substantially constant amplitude signals during a period of time that corresponds to the input video data when a dummy bit data included in the generated second video data are second dummy bit data.

* * * * *